US005765072A

United States Patent [19]

Ohtani et al.

[11] Patent Number: 5,765,072

[45] Date of Patent: Jun. 9, 1998

[54] TREATING SOLUTION SUPPLYING METHOD AND SUBSTRATE TREATING APPARATUS

[75] Inventors: Masami Ohtani; Yoshiteru Fukutomi, both of Kyoto, Japan

[73] Assignee: Dainippon Screen Mfg. Co. Ltd., Japan

[21] Appl. No.: 803,618

[22] Filed: Feb. 21, 1997

[30] Foreign Application Priority Data

Feb. 28, 1996 [JP] Japan ..... 8-069348

[51] Int. Cl.[6] ..... G03D 3/02

[52] U.S. Cl. ..... 396/626; 396/627; 396/611

[58] Field of Search ..... 396/611, 604, 396/627, 630; 355/43–45, 53, 77; 430/30

[56] References Cited

U.S. PATENT DOCUMENTS

| | | | |
|---|---|---|---|
| 4,286,541 | 9/1981 | Blackwood | 396/627 |
| 5,555,234 | 9/1996 | Sugimoto | 396/604 |
| 5,625,433 | 4/1997 | Inada et al. | 396/604 |

*Primary Examiner*—D. Rutledge

*Attorney, Agent, or Firm*—Ostrolenk, Faber, Gerb & Soffen, LLP

[57] ABSTRACT

A substrate treating apparatus includes a substrate treating station for performing a predetermined treatment of substrates by supplying a predetermined treating solution to the substrates, and at least one treating solution supply mechanism for supplying the treating solution in a forced feed under gas pressure to the substrate treating station. The solution supply mechanism has a treating solution storage tank, a pressurizing mechanism, a pressure release mechanism and a valve for selectively allowing and stopping supply of the treating solution. The storage tank begins to be pressurized a predetermined time before the treating solution is supplied to a first substrate in a lot including a plurality of substrates to be treated successively with the same solution. Pressure is released from the storage tank based on a time at which the treating solution is stopped being supplied to a last substrate in the lot or at a predetermined slightly later time. Such control is effected lot by lot. Gas dissolution in the treating solution is reduced without using an expensive gas which would result in high running cost.

22 Claims, 5 Drawing Sheets

TREATING SOLUTION SUPPLYING METHOD AND SUBSTRATE TREATING APPARATUS

BACKGROUND OF THE INVENTION (1) Field of the Invention

This invention relates to a treating solution supplying method for use in a substrate treating apparatus having a substrate treating station or stations for performing a predetermined treatment or treatments (e.g. photoresist application, development and the like) of substrates such as semiconductor wafers, glass substrates for liquid crystal displays, glass substrates for photomasks or substrates for optical disks, by supplying a predetermined treating solution or solutions (e.g. a photoresist solution, developer and rinsing solution) to the substrates, and a treating solution supply mechanism or mechanisms for supplying the treating solution(s) in a forced feed under gas pressure to the substrate treating station(s). The invention relates also to a substrate treating apparatus suited to implement the above treating solution supplying method.

(2) Description of the Related Art

The substrate treating apparatus of this type includes at least one treating solution supply mechanism for supplying a treating solution in a forced feed under gas pressure to the substrate treating station, as noted above. The treating solution supply mechanism includes a treating solution storage tank, a pressurizing mechanism, a pressure release mechanism and a solution supply/stop changeover valve.

The storage tank stores the treating solution in a sealed state. The pressurizing mechanism includes a pipe connected at one end thereof to a gas source and communicating at the other end with the storage tank, and a switch valve mounted on the pipe. The pressurizing mechanism is switchable between a state of supplying a gas into the storage tank to pressurize its interior and a state of stopping the gas supply to the storage tank.

The pressure release mechanism includes a pipe having one end thereof opening to the atmosphere and the other end communicating with the solution storage tank, and a switch valve mounted on the pipe. The pressure release mechanism is switchable between a state of communicating the interior of the storage tank to the atmosphere to release the internal pressure of the storage tank and a state breaking the communication between the storage tank and the atmosphere.

In a conventional substrate treating apparatus, when the apparatus is turned on, the switch valve of the pressure release mechanism is closed, and the switch valve of the pressurizing mechanism is opened. The interior of the solution storage tank is thereby pressurized to be ready to supply the treating solution to the substrate treating station. When a substrate is transported into the treating station for treatment, the treating solution supply/stop changeover valve is opened to supply the treating solution from the storage tank to the treating station. After the treating solution is supplied in a predetermined quantity, the supply/stop changeover valve is closed to stop the treating solution supply from the storage tank to the treating station. Thereafter, while the apparatus remains powered, the supply/stop changeover valve is repeatedly operated to supply and stop the treating solution in the course of treating substrates. When the apparatus is turned off, the switch valve of the pressure release mechanism is opened and the switch valve of the pressurizing mechanism is closed. Thus, the pressurization of the solution storage tank is stopped and its internal pressure is released.

In a conventional apparatus having a plurality of treating solution supply mechanisms, the above control is carried out for all of the treating solution supply mechanisms. That is, when the apparatus is turned on, pressurization is effected for all of the storage tanks of the solution supply mechanisms. While the apparatus remains powered, treating solutions are supplied from selected supply mechanisms to the treating station to treat substrates. When the apparatus is turned off, the pressurization of all of the solution storage tanks is stopped and the internal pressure is released therefrom.

The above prior art example has the following drawbacks.

As noted above, while the apparatus remains powered, the interiors of all of the storage tanks of the treating solution supply mechanisms are constantly pressurized. Generally, the apparatus of this type is turned on in the morning and turned off in the evening. The apparatus remains on for nearly a half day. Depending on operating conditions, the apparatus may be kept on all day or for several days. That is, in the conventional apparatus, the treating solution storage tanks are continuously pressurized for as long as a half day in an ordinary situation.

As for the gas for pressurizing the solution storage tanks, nitrogen ($N_2$) gas available at low cost is used. However, nitrogen gas tends to dissolve in the treating solutions easily. When the storage tanks are continuously pressurized for a long time, nitrogen gas is highly likely to dissolve in the treating solutions. The gas dissolved in the treating solutions vaporizes as a result of pressure release from the solutions supplied from the storage tanks to the treating station. It is difficult to supply the treating solutions to substrates in a stable manner. In addition, bursting gas bubbles scatters the treating solutions to areas other than intended positions on the substrates, resulting in flaws on the substrates. When applying a photoresist solution, for example, what is called degassing occurs after a substrate is coated with a film of the photoresist solution (treating solution) having gas bubbles mixed therein. The degassing forms pinholes in the film.

Where, for example, helium (He) gas is used to pressurize the interiors of the treating solution storage tanks, the gas dissolves in a less quantity in the treating solutions. However, helium gas is expensive, which gives rise to a different disadvantage of increased running cost.

SUMMARY OF THE INVENTION

This invention has been made having regard to the state of the art noted above, and its object is to provide a treating solution supplying method and a substrate treating apparatus capable of diminishing gas dissolution in a treating solution without entailing high running cost.

The above object is fulfilled, according to this invention, by a treating solution supplying method for use in a substrate treating apparatus having at least one substrate treating station for performing a predetermined treatment of substrates by supplying a predetermined treating solution to the substrates, and at least one treating solution supply mechanism for supplying the treating solution in a forced feed under gas pressure to the substrate treating station, wherein at least one substrate treated with one type of treating solution in the substrate treating apparatus is processed as one lot, pressurization of a treating solution storage tank of the treating solution supply mechanism supplying the treating solution to the substrate treating station for treating the substrate in the lot being started a predetermined time before the treating solution is supplied to a first substrate in the lot, and control being effected for each lot to release pressure from the treating solution storage tank of the treating solution supply mechanism based on a time at which the treating solution is stopped being supplied to a last substrate in the lot or at a predetermined slightly later time.

The predetermined time before the treating solution is supplied to the first substrate in the lot may be a period of time taken from start of the pressurization of the treating solution storage tank of the treating solution supply mechanism supplying the treating solution to a time when the treating solution storage tank is pressurized to a degree for enabling the treating solution to be supplied from the treating solution storage tank to the substrate treating station, or a slightly longer period of time.

The period of time taken from start of the pressurization of the treating solution storage tank to the time when the treating solution storage tank is pressurized to a degree for enabling the treating solution to be supplied from the treating solution storage tank to the substrate treating station may be determined from a capacity of the storage tank and a gas supply per unit time to the storage tank. The above period of time may be determined also from a residual quantity of the treating solution in the storage tank.

In another aspect of this invention, there is provided a substrate treating apparatus having at least one substrate treating station for performing a predetermined treatment of substrates by supplying a predetermined treating solution to the substrates, and at least one treating solution supply mechanism for supplying the treating solution in a forced feed under gas pressure to the substrate treating station, the treating solution supply mechanism comprising:

a treating solution storage tank for storing a predetermined treating solution;

a pressurizing device for pressurizing the treating solution storage tank by supplying a gas thereinto;

a pressure release device for releasing pressure from the treating solution storage tank; and a solution supply/stop changeover device for selectively allowing and stopping supply of the treating solution from the treating solution storage tank to the substrate treating station;

wherein the apparatus comprises a control device for causing at least one substrate treated with one type of treating solution in the substrate treating apparatus to be processed as one lot, the control device being operable to start pressurization of the treating solution storage tank of the treating solution supply mechanism supplying the treating solution to the substrate treating station for treating the substrate in the lot, a predetermined time before the treating solution is supplied to a first substrate in the lot, and to effect a control for each lot to release pressure from the treating solution storage tank of the treating solution supply mechanism based on a time at which the treating solution is stopped being supplied to a last substrate in the lot or at a predetermined slightly later time.

The control device may be operable, prior to starting supply of the treating solution to the first substrate in the lot, to start pressurization of the treating solution storage tank of the treating solution supply mechanism supplying the treating solution, before a period of time taken from start of the pressurization of the treating solution storage tank to a time when the treating solution storage tank is pressurized to a degree for enabling the treating solution to be supplied from the treating solution storage tank to the substrate treating station, or a slightly longer period of time.

One lot in this invention means a set of substrates continuously treated with the same treating solution in the substrate treating apparatus. When, for example, one substrate alone is treated in the apparatus, this substrate forms one lot. When a plurality of substrates are continuously treated with the same treating solution in the apparatus, these substrates form one lot.

The term "continuously treated" refers to a substrate treatment continuous in time. Assume, for example, a case of treating substrates m+n in number (m and n each being natural number 1 or more), wherein the treatment is suspended after m substrate(s) and then resumed for n substrate (s). Then, the m substrate(s) and n substrate(s) each form one lot.

Where the apparatus comprises a plurality of treating solution supply mechanisms for individually supplying different treating solutions, start of the pressurization and pressure release for the treating solution supply mechanisms are controlled based on respective lots to which the treating solution supply mechanisms are directed.

In this case, one lot associated with each treating solution supply mechanism may be a set of the same substrates or a set of different substrates.

For example, the apparatus may include treating solution supply mechanism A for supplying treating solution a, and treating solution supply mechanism B for supplying treating solution b. The substrate treating station treats substrates with solution a and solution b. Where m substrates are continuously treated in the substrate treating station in this way, the one lot associated with each of the treating solution supply mechanisms A and B is a set of m substrates.

In this case, pressurization is started for treating solution supply mechanism A based on a start of supply of treating solution a to the first substrate in that lot. Pressure is released from treating solution supply mechanism A based on a termination of supply of treating solution a to the last substrate in that lot. On the other hand, pressurization is started for treating solution supply mechanism B based on a start of supply of treating solution b to the first substrate in that lot. Pressure is released from treating solution supply mechanism B based on a termination of supply of treating solution b to the last substrate in that lot.

Assume that the apparatus, again, includes treating solution supply mechanism A for supplying treating solution a, and treating solution supply mechanism B for supplying treating solution b. The substrate treating station treats m+n substrates continuously, first with solution a supplied to the m substrates, and next with solution b supplied to the n substrates. Then, the one lot associated with treating solution supply mechanisms A is a set of the m substrates treated first, while the one lot associated with treating solution supply mechanisms B is a set of the n substrates treated next.

In this case also, pressurization is started for each of treating solution supply mechanisms A and B based on a start of supply of treating solution a or b to the first substrate in the lot, and pressure is released from each of treating solution supply mechanisms A and B based on a termination of supply of treating solution a or b to the last substrate in the lot. Thus, the solution storage tanks of treating solution supply mechanisms A and B are staggered for pressurization. Basically, it is possible to maintain the storage tank of treating solution supply mechanism B depressurized while the storage tank of treating solution supply mechanism A is pressurized, and vice verse.

Further, the apparatus may include treating solution supply mechanism A for supplying treating solution a, treating solution supply mechanism B for supplying treating solution b, and treating solution supply mechanism C for supplying treating solution c. The substrate treating station treats m+n substrates continuously, first with solutions a and c supplied to the m substrates, and next with solutions b and c supplied to the n substrates. Then, the one lot associated with treating solution supply mechanisms A is a set of the m substrates treated first, the one lot associated with treating solution supply mechanisms B is a set of the n substrates treated next, and the one lot associated with treating solution supply mechanisms C is a set of all m+n substrates.

According to this invention, the pressurizing device is controlled to start pressurization of the storage tank of the treating solution supply mechanism supplying one type of treating solution to the substrate treating station for treating the substrate(s) in one lot which is continuously treated with that one type of treating solution in the substrate treating apparatus, a predetermined time before the treating solution is supplied to a first substrate in that lot. This predetermined time is a period of time taken from start of the pressurization of the storage tank of the treating solution supply mechanism supplying the treating solution to a time when the storage tank is pressurized to a degree for enabling the treating solution to be supplied from the storage tank to the substrate treating station, or a slightly longer period of time.

With the above control, the treating solution is ready to be supplied from the storage tank to the substrate treating station by the time the treating solution begins to be supplied to the first substrate in that lot. The treating solution may be supplied to the first substrate by operating the solution supply/stop changeover device of the treating solution supply mechanism. Thereafter the solution supply/stop changeover device is operated to supply the treating solution successively to the other substrates in the same lot.

At a point of time for stopping the treating solution supply to the last substrate in that lot, or at a slightly later point of time, the pressure release device is controlled to release the pressure from the storage tank. The point of time slightly later than the solution stopping point of time may, for example, be a point of time for completing the treatment of the last substrate in the substrate treating station, or a point of time the last substrate is unloaded from the substrate treating apparatus. The time for pressurizing the storage tank may be reduced by releasing pressure from the storage tank based on the time for stopping the treating solution supply to the last substrate in each lot.

In this invention, the pressurizing device and pressure release device are repeatedly controlled, as described above, for each lot.

Where the apparatus includes a plurality of treating solution supply mechanisms for individually supplying the same treating solution to the same substrate treating station, the plurality of treating solution supply mechanisms are switchable for use, and the start of pressurization and pressure release for one of the treating solution supply mechanisms currently used is controlled based on respective lots to which the one of the treating solution supply mechanisms is directed.

In this case, when the treating solution remaining in the treating solution storage tank of the one treating solution supply mechanism currently used falls below a predetermined level, switching may be made from the one treating solution supply mechanism currently used to a different treating solution supply mechanism for supplying the same treating solution to the substrate treating station as the treating solution supply mechanism, and the treating solution storage tank of the one treating solution supply mechanism may be replenished with the treating solution.

This feature will eliminate the inconvenience of the storage tank becoming empty of the treating solution and hence incapable of supplying the solution.

The substrate treating apparatus has so-called down times, during which no substrate treatment takes place, after the apparatus is turned on and before the apparatus is turned off. In this invention, the pressurizing device and pressure release device are controlled assiduously to maintain the storage tank free from pressure at least during such down times. The storage tank is pressurized for a correspondingly reduced time, compared with the conventional apparatus. Thus, even where the storage tank is pressurized with the same low-cost gas as in the conventional apparatus, the gas is dissolved in a reduced quantity in the treating solution inside the storage tank. Where the apparatus includes a plurality of treating solution supply mechanisms for supplying different treating solutions to the substrate treating station, the down times may vary among the supply mechanisms. In this invention, the storage tank of each treating solution supply mechanism is pressurized only when necessary.

The substrate treating apparatus according to this invention may further comprise:

at least one carrier support for supporting a carrier having a capacity for storing a plurality of substrates;

at least one switch unit associated with the carrier support for inputting treating conditions and a treatment start instruction with respect to at least one substrate stored in the carrier placed on the carrier support; and a transport device for fetching the substrate(s) successively, transporting the substrate(s) successively according to a predetermined treating sequence, and depositing the substrate(s) successively in the carrier after a predetermined treatment;

wherein the control device is operable, in response to the treatment start instruction inputted through the switch unit, to control the transport device and the substrate treating station to successively treat the substrate(s) taken out of the carrier placed on the carrier support associated with the switch unit through which the treatment start instruction is inputted, according to the treating conditions designated, and to control start of the pressurization and release of the pressure for at least one treating solution supply mechanism used in continuous treatment of the substrate(s), based on respective lots to which the at least one treating solution supply mechanism is directed.

The apparatus may comprise a plurality of carrier supports, and switch units associated with the carrier supports, respectively, the control device being operable, in response to treatment start instructions inputted through the switch units, to cause all substrates stored in a plurality of carriers to be treated successively in an order in which the treatment start instructions are inputted.

The control device may be operable to start pressurization for all of the treating solution supply mechanisms to be used in the successive treatment of the substrates carried out upon the treatment start instructions, at points of time the treatment start instructions are inputted, or at points of time first substrates in the respective lots to which the treating solution supply mechanisms are directed are transported from the carrier into the transport treating apparatus.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENT

A preferred embodiment of this invention will be described in detail hereinafter with reference to the drawings.

An outline of the embodiment will be described with reference to FIGS. 1 and 2.

Figure 1:
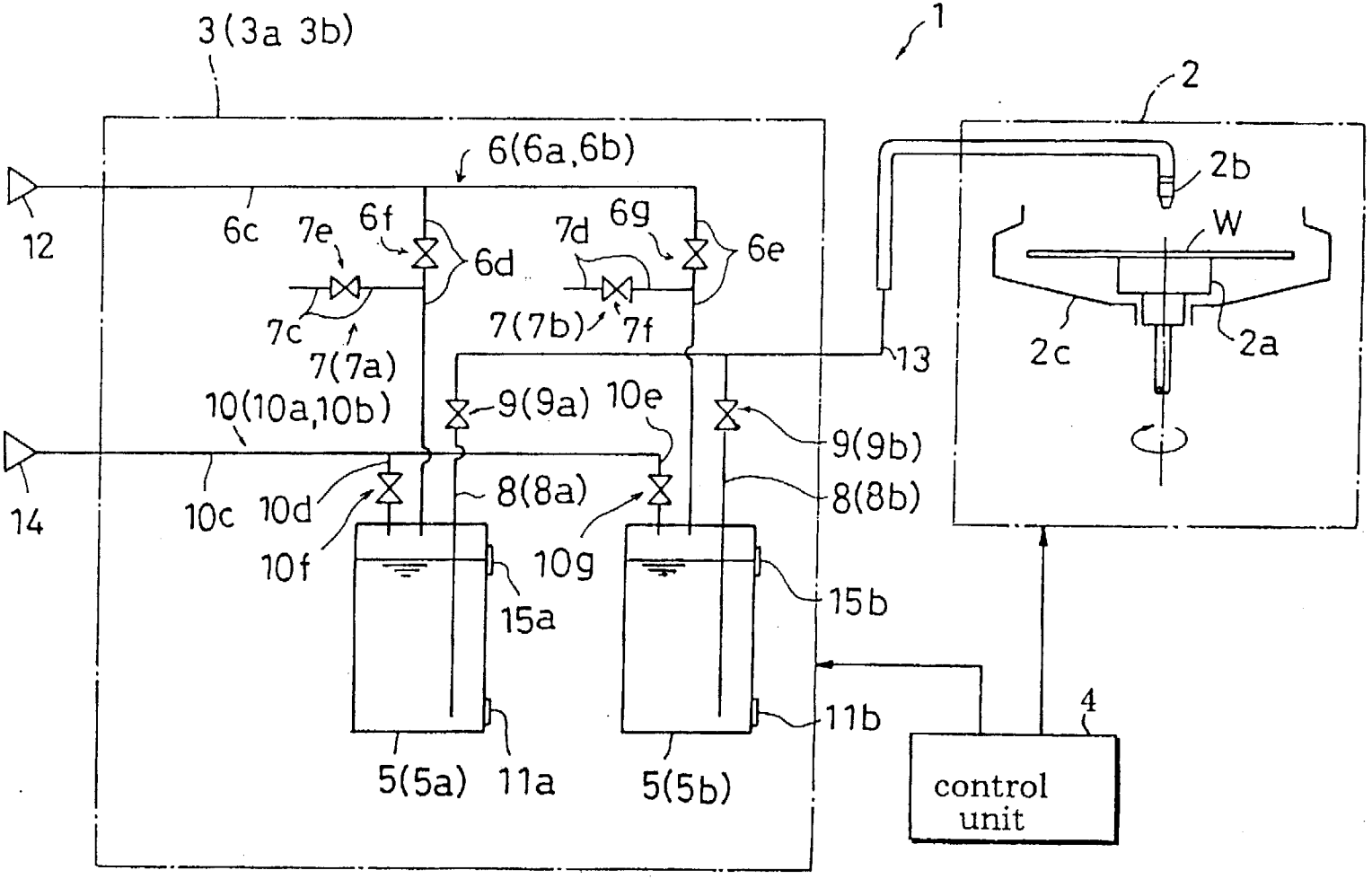
FIG. 1 is a view showing an outline of an embodiment of this invention.

As shown in FIG. 1, this substrate treating apparatus 1 includes one or more substrate treating stations 2 (only one being shown in FIG. 1), a treating solution supply mechanism 3, and a control unit 4 acting as control means of this invention. The treating solution supply mechanism 3 includes treating solution storage tanks 5 (5*a*, 5*b*), pressurizing mechanisms (pressurizing device) 6 (6*a*, 6*b*), pressure release mechanisms (pressure release device) 7 (7*a*, 7*b*), treating solution supply pipes 8 (8*a*, 8*b*), switch valves 9 (9*a*, 9*b*) acting as the treating solution supply/stop changeover device, and treating solution replenish mechanisms (treating solution replenish device) 10 (10*a*, 10*b*).

The substrate treating station 2 is operable to provide a predetermined treatment (e.g. photoresist application, development, edge rinsing or back rinsing) of substrates or wafers W with a treating solution (e.g. a photoresist solution, developer or a rinsing solution (solvent) for edge rinsing or back rinsing) supplied to the wafers W. This type of treatment is performed while spinning each wafer W in horizontal posture about a vertical axis. For this purpose, the substrate treating station 2 includes a spin chuck 2*a*. The treating station 2 further includes a nozzle 2*b* for directing the treating solution to the wafer W supported on the spin chuck 2*a*, and a scatter preventive cup 2*c* for preventing the treating solution from scattering from the spinning wafer W to the ambient.

The treating solution supply mechanism 3 shown in FIG. 1 includes a first treating solution supply mechanism 3*a* and a second treating solution supply mechanism 3*b*. The first supply mechanism 3*a* has a treating solution storage tank 5*a*, a pressurizing mechanism 6*a*, a pressure release mechanism 7*a*, a treating solution supply pipe 8*a*, a switch valve 9*a* and a treating solution replenish mechanism 10*a*. The second supply mechanism 3*b* has a treating solution storage tank 5*b*, a pressurizing mechanism 6*b*, a pressure release mechanism 7*b*, a treating solution supply pipe 8*b*, a switch valve 9*b* and a treating solution replenish mechanism 10*b*. With the two supply mechanisms 3*a* and 3*b* provided, a stoppage of treating solution to the substrate treating station 2 may be avoided even when the treating solution in one of the storage tanks 5 diminishes below a predetermined level and requires replenishment. Assume that when one of the supply mechanisms 3 (e.g. the first supply mechanism 3*a*) supplies the treating solution (with the other supply mechanism 3*b* standing by), the treating solution in the storage tank 5*a* of the first supply mechanism 3*a* diminishes below the predetermined level. Then, switching is effected for the other supply mechanism 3 (i.e. the second supply mechanism 3*b*) to supply the treating solution, and the storage tank 5*a* of the first supply mechanism 3*a* is replenished with the treating solution. After the replenishment of the treating solution for the storage tank 5*a* of the first supply mechanism 3*a* is completed, the first supply mechanism 3*a* is put on standby. When the treating solution in the storage tank 5*b* of the second supply mechanism 3*b* diminishes below the predetermined level, switching is effected for the first supply mechanism 3*a* to supply the treating solution, and the storage tank 5*b* of the second supply mechanism 3*b* is replenished. In this way, switching is made successively between the first supply mechanism 3*a* and second supply mechanism 3*b* to supply the treating solution constantly to the substrate treating station 2.

The switching between the first supply mechanism 3*a* and second supply mechanism 3*b* is controlled by the control unit 4. The storage tanks 5*a* and 5*b* have sensors (e.g. capacitive sensors) 11*a* and 11*b*, respectively, for detecting the treating solution falling below the predetermined level.

The treating solution is contained in a sealed condition in each of the storage tanks 5*a* and 5*b*.

The pressurizing mechanisms 6 include a pipe 6*c* connected at one end thereof to a gas source 12, pipes 6*d* and 6*e* branched from the other end of pipe 6*c* and communicating with the storage tanks 5*a* and 5*b*, respectively, and switch valves 6*f* and 6*g* mounted on the pipes 6*d* and 6*e*, respectively. The gas source 12, pipes 6*c* and 6*d*, and switch valve 6*f* constitute the pressurizing mechanism 6*a*. The gas source 12, pipes 6*c* and 6*e*, and switch valve 6*g* constitute the pressurizing mechanism 6*b*.

The pressure release mechanisms 7 include a pipe 7*c* connected at one end thereof to the pipe 6*d* and open at the other end to the atmosphere, a pipe 7*d* connected at one end thereof to the pipe 6*e* and open at the other end to the atmosphere, and switch valves 7*e* and 7*f* mounted on the pipes 7*c* and 7*d*, respectively. The pipe 7*c* and switch valve 7*e* (and pipe 6*d*) constitute the pressure release mechanism 7*a*. The pipe 7*d* and switch valve 7*f* (and pipe 6*e*) constitute the pressure release mechanism 7*b*.

Each of the treating solution supply pipes 8*a* and 8*b* extending into the treating solution in the storage tank 5*a* or 5*b* is connected to a pipe 13 connected at one end thereof to the nozzle 2*b* in the substrate treating station 2. The switch valves 9*a* and 9*b* are mounted on the supply pipes 8*a* and 8*b*, respectively. It will be noted that the supply pipes 8*a* and 8*b* are branched from the other end of the pipe 13.

For pressurizing the storage tank 5*a* (or 5*b*), the switch valve 7*e* (or 7*f*) is closed and the switch valve 6*f* (or 6*g*) is opened. When the interior of the storage tank 5*a* (or 5*b*) is pressurized to a predetermined degree, the switch valve 9*a* (or 9*b*) is opened to supply the treating solution from the storage tank 5*a* (or 5*b*) to the substrate treating station 2 (i.e. to the nozzle 2*b*). The treating solution supply is stopped by closing the switch valve 9*a* (or 9*b*). The pressurization of the storage tank 5*a* (or 5*b*) is stopped and pressure is released therefrom by closing the switch valve 6*f* (or 6*g*) and opening the switch valve 7*e* (or 7*f*).

The treating solution replenish mechanisms 10 include a pipe 10*c* connected at one end thereof to a treating solution source 14, pipes 10*d* and 10*e* branched from the other end of pipe 10*c* and communicating with the storage tanks 5*a* and 5*b*, respectively, and switch valves 10*f* and 10*g* mounted on the pipes 10*d* and 10*e*, respectively. The solution source 14, pipes 10*c* and 10*d*, and switch valve 10*f* constitute the replenish mechanism 10*a*. The solution source 14, pipes 10*c* and 10*e*, and switch valve 10*g* constitute the replenish mechanism 10*b*.

For replenishing the storage tank 5*a* (or 5*b*) with the treating solution, the switch valve 6*f* (or 6*g*) is closed and the switch valve 7*e* (or 7*f*) is opened to release the pressure from the storage tank 5*a* (or 5*b*), and then the switch valve 10*f* (or 10*g*) is opened. The storage tanks 5*a* and 5*b* have sensors (e.g. capacitive sensors) 15*a* and 15*b*, respectively, for detecting the treating solution collected in a predetermined quantity therein.

When the treating solution collected in the predetermined quantity is detected, the switch valve 10*f* (or 10*g*) is closed to complete the replenishment with the treating solution.

The control unit 4 controls the switching between the first and second treating solution supply mechanisms 3*a* and 3*b* for supplying the treating solution supply to the substrate treating station 2 (including the replenishment with the treating solution). The first and second treating solution supply mechanism 3*a* and 3*b* are controlled to supply the treating solution to the substrate treating station 2 lot by lot. This aspect will be described with reference to FIG. 2.

Figure 2:
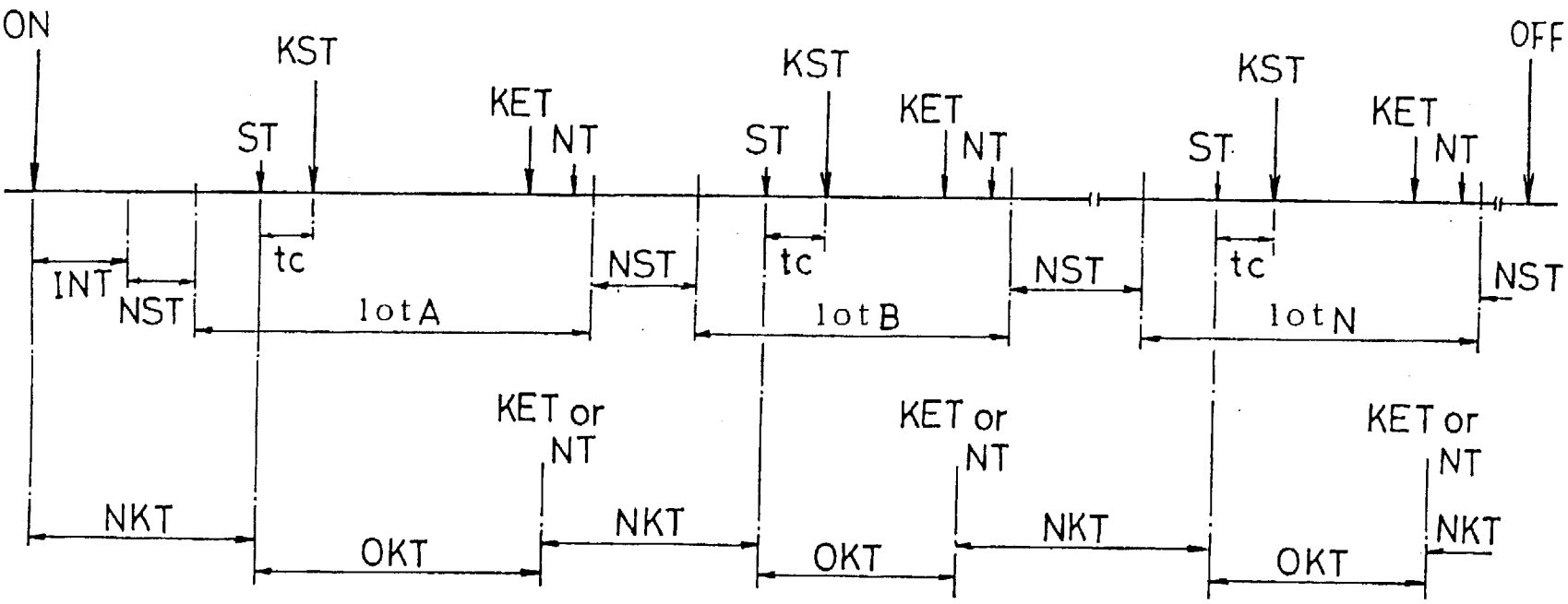
FIG. 2 is a view showing timing of pressurization of treating solution storage tanks and pressure release therefrom according to this invention.

In FIG. 2, "ON" indicates a point of time at which this substrate treating apparatus is turned on, and "OFF" indicates a point of time at which the substrate treating apparatus 1 is turned off. Generally, when turned on, the apparatus 1 is initialized (as at INT) to become operative. Once the apparatus 1 is in operative state, wafers W may be transported into and out of the apparatus 1 and within the apparatus 1, and the treatment may be carried out in the substrate treating station 2.

While the apparatus 1 is in the operative state, a plurality of wafers W are transported in lots into the apparatus 1, treated and transported out of the apparatus 1. As noted hereinbefore, one lot in this invention means a set of wafers W continuously treated with the same treating solution in the substrate treating apparatus 1. One lot may include one wafer W or a plurality of wafers W.

At a point of time ST, the control unit 4 controls the pressurizing mechanism 6 (6*a* or 6*b*) and pressure release mechanism 7 (7*a* or 7*b*) to start pressurizing the treating solution storage tank 5 (5*a* or 5*b*), whichever is used to supply the treating solution). This point of time ST is a predetermined time tc before the treating solution begins to be supplied to the first wafer W in each of the lots (shown as lots A, B, . . . , N in FIG. 2) continuously processed by the substrate treating apparatus 1. Reference KST in FIG. 2 denotes a point of time the treating solution begins to be supplied to the first wafer W in each lot.

The predetermining time tc is a period of time from the start of pressurization of the storage tank 5 to the time the storage tank 5 is pressurized to a sufficient degree for supplying the treating solution to the substrate treating station 2, or a slightly longer time. This period of time is dependent upon the capacity of the storage tank 5, the quantity of gas supply per unit time from the gas source 12 and so on, and may be determined empirically beforehand. This period of time is also variable with the quantity of treating solution remaining in the storage tank 5. The quantity of treating solution remaining in the storage tank 5 may be detected, and the period of time may be adjusted based on the quantity of residual treating solution detected. However, to simplify the control, the above period of time may be determined according to the capacity of the storage tank 5 itself, regardless of the quantity of treating solution remaining in the storage tank 5.

With the above control, the treating solution is ready to be supplied from the storage tank 5 to the substrate treating station 2 by the point of time KST the treating solution begins to be supplied to the first wafer W in each lot. The treating solution is supplied to the first wafer W by operating the switch valve 9 (9*a* or 9*b*). Thereafter the switch valve 9 (9*a* or 9*b*) is operated to supply the treating solution successively to the other wafers W in the same lot.

At a point of time KET for stopping the treating solution supply to the last wafer W in each lot, or at a slightly later point of time NT, the control unit 4 controls the pressurizing mechanism 6 (6*a* or 6*b*) and pressure release mechanism 7 (7*a* or 7*b*) to release the pressure from the storage tank 5. The point of time NT slightly later than the solution stopping point of time KET may, for example, be a point of time of completion of the treatment of the last wafer W in the substrate treating station 2, or a point of time the last wafer W is transported out of the substrate treating apparatus 1. The time for pressurizing the storage tank 5 may be reduced by releasing the pressure from the storage tank 5 based on the time KET for stopping the treating solution supply to the last wafer W in each lot.

Where one lot includes a single wafer W, the first wafer W and the last wafer W in that lot are one and the same wafer W.

The control unit 4 repeatedly controls the pressurizing mechanism 6 and pressure release mechanism 7 for each lot (lots A, B, . . . , N).

Where the substrate treating apparatus 1 has a plurality of treating solution supply mechanisms 3 for supplying different treating solutions to the substrate treating station 2, pressurization start and pressure release controls as shown in FIG. 2 are carried out for each of the treating solution supply mechanisms 3. As noted hereinbefore, the lots A, B, . . . , N for which each treating solution supply mechanism 3 is operated in this case may be sets of the same wafers W or sets of different wafers W. The control unit 4, based on processing conditions set by the operator or the like, carries out pressurization start and pressure release controls for each treating solution supply mechanism 3 according to the lot to which the supply mechanism 3 is directed.

As seen from FIG. 2, so-called down times NST, during which no substrate treatment takes place, occur after the substrate treating apparatus 1 is turned on and before the treating apparatus 1 is turned off. In this invention, the pressurizing mechanism 6 and pressure release mechanism 7 are controlled assiduously to maintain the storage tank 5 free from pressure as long as possible while pressurization of the storage tank 5 is not required, let alone during the down times NST. That is, according to this invention, the storage tank 5 is pressurized during periods NKT and depressurized during periods NKT in FIG. 2. Consequently, compared with the conventional apparatus, a reduced quantity of gas is dissolved in the treating solution inside the storage tank 5.

In the case of a conventional apparatus having a plurality of treating solution supply mechanisms for supplying different treating solutions to the substrate treating station, the storage tanks of all of the treating solution supply mechanisms are pressurized while the apparatus is powered. According to this invention, the storage tank 5 of each treating solution supply mechanism 3 is pressurized only when necessary, thereby reducing gas dissolution in the treating solution inside the storage tank 5 of each treating solution supply mechanism 3.

A specific example of apparatus embodying this invention will be described hereinafter with reference to FIGS. 3 through 6.

This apparatus 1 includes an indexer 20 for loading and unloading wafers W into/out of the apparatus 1, a spin coater 2 acting as a substrate treating station, a heat-treating unit 21 for heating and cooling wafers W, a substrate transport robot 22 for transporting wafers W within the apparatus 1, a treating solution supply system and a control system.

Figure 3:
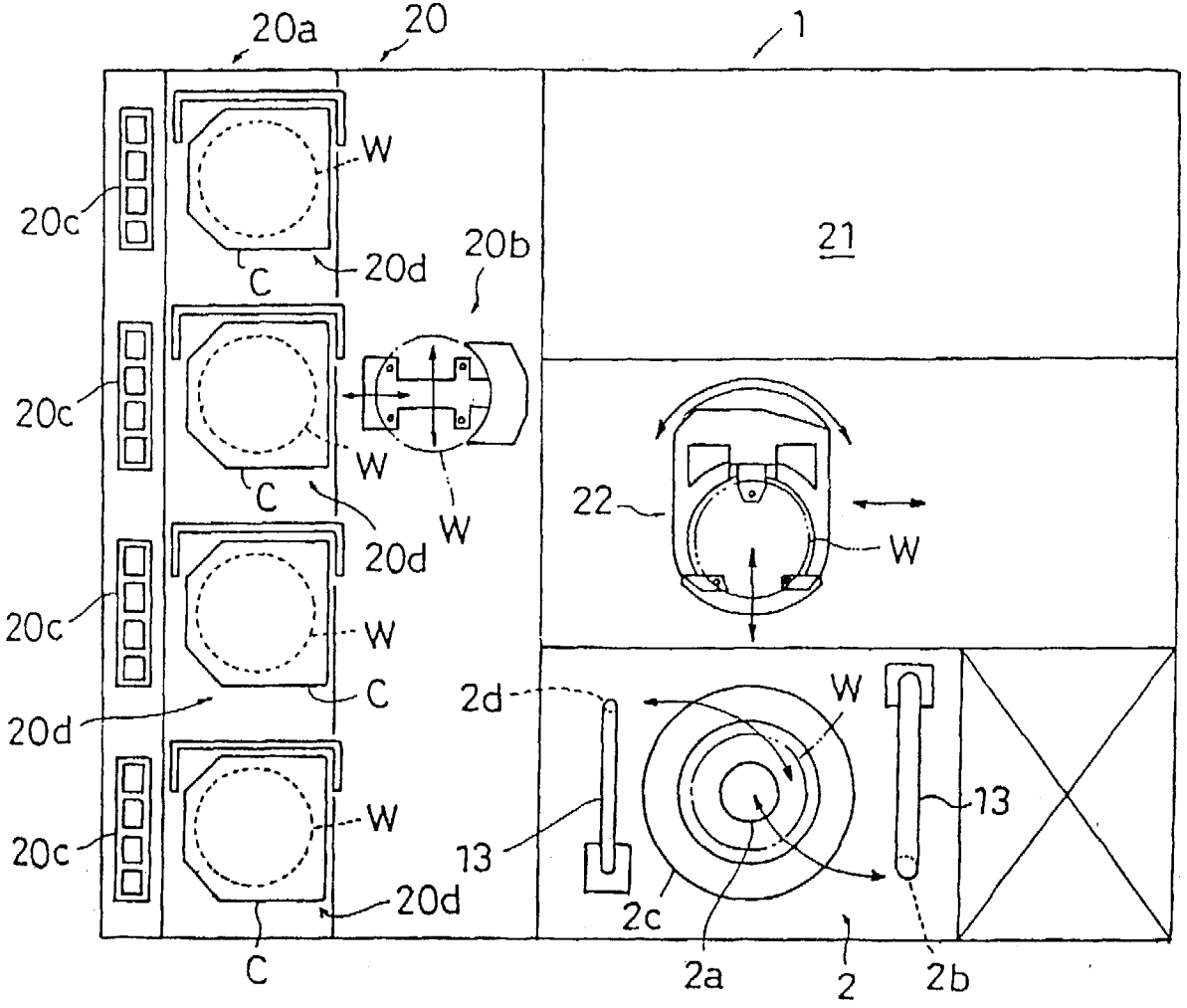
FIG. 3 is an overall plan view of an apparatus embodying this invention.

The indexer 20 includes a carrier support table 20*a* for supporting carriers C each of which can store a plurality of wafers W in horizontal posture and stacked in a direction perpendicular to the plane of FIG. 3. The indexer 20 further includes a substrate intake/output robot 20*b* for transferring wafers W between carriers C and substrate transport robot 22 to load and unload wafers W into/out of the apparatus 1, and switch units 20*c* for inputting start instructions and recipes (treating conditions).

The carrier support table 20*a* includes a plurality of (four in FIG. 3) carrier supports 20*d*. The switch units 20*c* are provided for the respective carrier supports 20*d*. Each switch unit 20*c* is used to set a recipe for the wafers W stored in the carrier C placed on the associated carrier support 20*d*, and to instruct a start of treatment for the wafers W in that carrier C. The carriers C are placed on and removed from the carrier supports 20*d* by an auto guided vehicle or manually. The recipes and start instructions are manually inputted through the switch units 20*c*.

When a start is instructed, the substrate intake/output robot 20*b* takes wafers W one by one out of the carrier C placed on a corresponding one of carrier supports 20*d*, and successively delivers the wafers W to the substrate transport robot 22. Further, the substrate intake/output robot 20*b* receives wafers W having undergone a predetermined treatment from the substrate transport robot 22, and deposits the wafers W in original storage positions in the carrier C from which the wafers W have been taken.

The substrate transport robot 22, having received wafers W from the substrate intake/output robot 20, transports the wafers W to the heat-treating unit 21 and spin coater 2 according to a predetermined processing sequence. After the predetermined treatment, the transport robot 22 successively delivers the wafers W to the substrate intake/output robot 20*b*. The substrate intake/output robot 20*b* and substrate transport robot 22 constitute the transport device of this invention.

The spin coater 2 is operable to apply a photoresist film to each wafer W while spinning the wafer W. The spin coater 2 includes a spin chuck 2*a* for spinning the wafer W in horizontal posture, a resist supply nozzle 2*b* for supplying a treating solution photoresist solution) to the wafer W supported by the spin chuck 2*a*, and a scatter preventive cup 2*c* for preventing the photoresist solution or other treating solution scattering around the spinning wafer W under treatment. The spin coater 2 further includes an edge rinse nozzle 2*b* for supplying a rinsing solution adjacent the edge of the spinning wafer W to effect edge rinsing, and a back rinse nozzle 2*e* for supplying a rinsing solution to the lower surface of the spinning wafer W to effect back rinsing (see FIG. 4).

The heat-treating unit 21 includes a plurality of substrate heaters (not shown) having hot plates for heating wafers W to a predetermined temperature, and a plurality of substrate coolers (not shown) having cool plates for cooling the wafers W heated by the heaters, to a predetermined temperature near room temperature.

Figure 4:
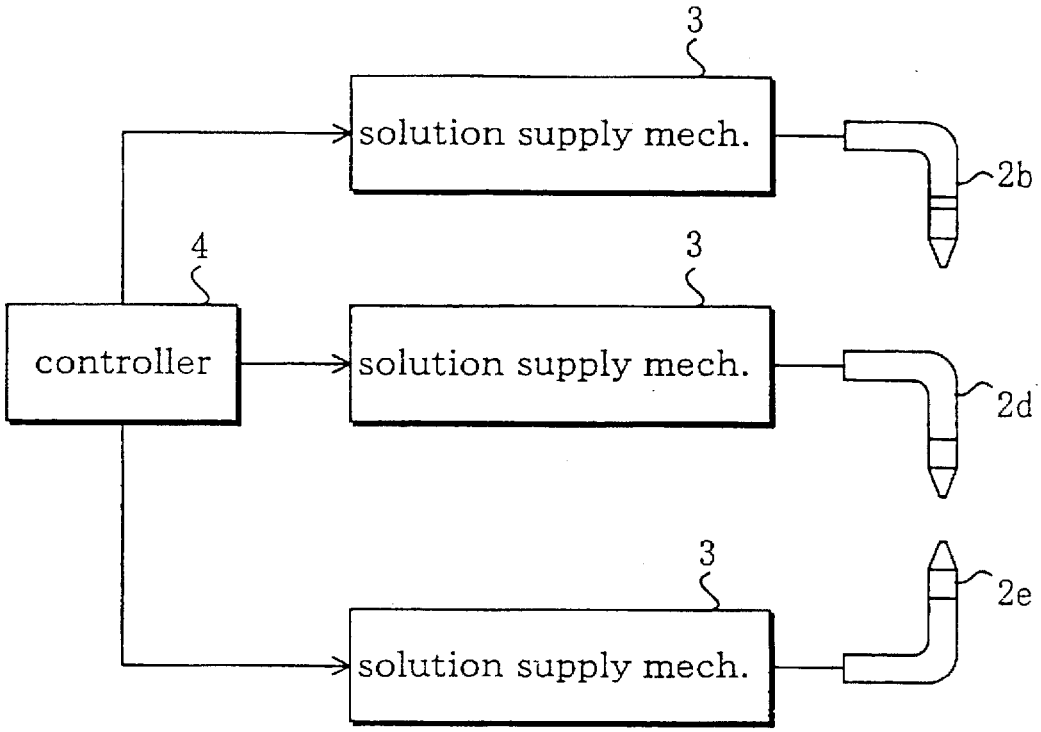
FIG. 4 is a view showing an outline of a treating solution supply system employed in the apparatus shown in FIG. 3.

As shown in FIG. 4, the treating solution supply system of this apparatus 1 includes the treating solution supply mechanisms 3 described with reference to FIG. 1, connected to each of the resist supply nozzle 2*b*, edge rinse nozzle 2*c* and back rinse nozzle 2*e*.

The control unit 4 controls the treating solution supply mechanisms 3 individually to supply and stop the treating solution from the respective nozzles 2*b*, 2*d* and 2*e*, and to switch between pressurization and depressurization of the treating solution storage tanks 5. The photoresist solution is stored in the storage tanks 5 of the treating solution supply mechanisms 3 connected to the resist supply nozzle 2*b*. The edge rinsing solution and back rinsing solution are stored in the storage tanks 5 of the treating solution supply mechanisms 3 connected to the edge rinse nozzle 2*d* and back rinse nozzle 2*e*, respectively.

Figure 5:
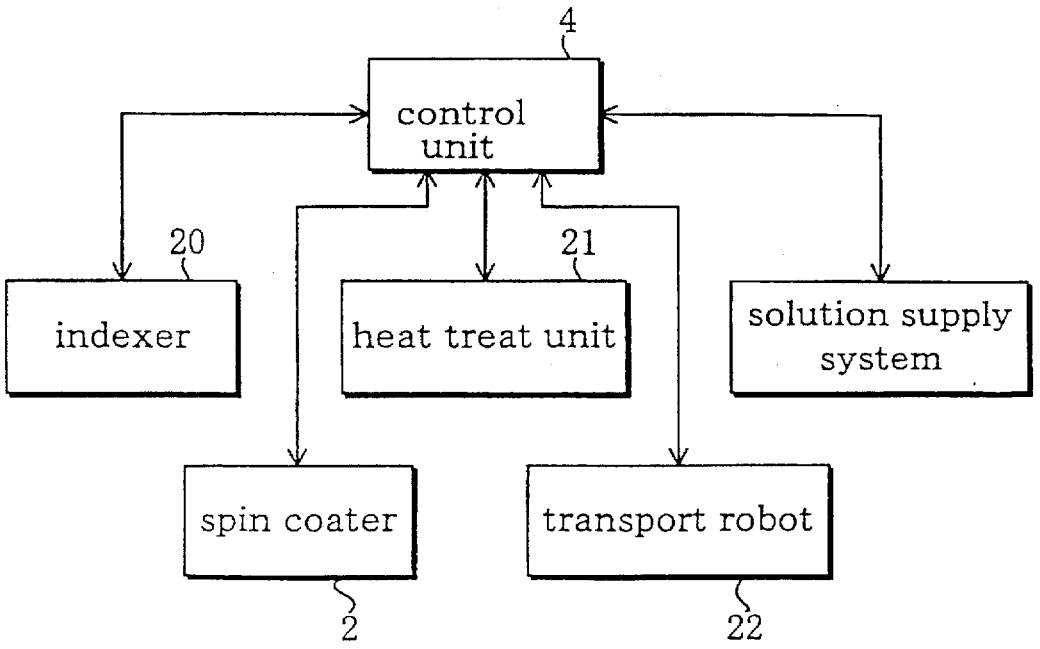
FIG. 5 is view showing an outline of a control system in the apparatus shown in FIG. 3.

The control unit 4 of this apparatus 1 controls the entire apparatus 1 as well as the treating solution supply system. That is, as shown in FIG. 5, the control unit 4 is connected to the indexer 20, spin coater 2, heat-treating unit 21, substrate transport robot 22, and the treating solution supply system (i.e. each treating solution supply mechanism 3). The control unit 4 receives necessary information from the above components, and controls these components based on this information.

A processing sequence from loading of wafers W into the above apparatus 1 to unloading of the wafers W therefrom will be described in relation to one carrier C, with reference to the flowchart shown in FIG. 6.

The carrier C is placed on one of the carrier supports 20*d* (Step S1). Next, a recipe for the wafers W stored in the carrier C is set through the switch unit 20*c* corresponding to that carrier support (Step S2) The recipe is inputted to the control unit 4. The control unit 4 controls the heat-treating unit 21, spin coater 2 and other components to carry out a subsequent wafer treatment according to the recipe.

When a start instruction is inputted through the same switch unit 20*c*, the treatment is started for the wafers W stored in the carrier C (Step S3). That is, the substrate intake/output robot 20*b*, under control of the control unit 4, takes the wafers W one by one out of the carrier C, and successively delivers the wafers W to the substrate transport robot 22 (Step S4). The substrate transport robot 22, under control of the control unit 4, transports the wafers W to a heater in the heat-treating unit 21. The wafers W are heated therein under control of the control unit 4 (Step S5). Next, the substrate transport robot 22, under control of the control unit 4, transports the wafers W from the heater to a cooler. The wafers W are cooled therein under control of the control unit 4 (Step S6). Then, the transport robot 22 transports the wafers W from the cooler to the spin coater 2. The photoresist is applied to the wafers W therein (including edge rinsing and back rinsing) under control of the control unit 4 (Step S7). Next, the transport robot 22 transports the wafers W successively to a heater and a cooler. The wafers W are heated and then cooled therein under control of the control unit 4 (Steps S8 and S9). The above steps S4 through S9 are executed concurrently for a plurality of wafers W. For example, when the first wafer W is treated by the spin coater 2, the second wafers W is cooled in the cooler, the third wafer W is heated in the heater, and the fourth wafer W is transported into the apparatus 1.

The wafers W having undergone the series of treatments at the above steps S5–S9 are transferred from the substrate transport robot 22 to the substrate intake/output robot 20*b*. The wafers W are deposited in the original storage positions in the carrier C (Step S10). The carrier C is removed from the carrier support 20*d* when all of the wafers W have undergone the above steps S5–S9 and deposited in the carrier C (Step S11).

Each wafer W has an ID for distinguishing it from other wafers W. The loading, varied treatments, transportation within the apparatus 1, and unloading of the wafers W are managed with reference to the IDs.

The control unit 4 stores processing states of the respective carrier supports 20*d* to determine whether processing is in progress at the carrier supports 20*d* or not. For example, when a start instruction is inputted through the switch unit 20*c* corresponding to a certain carrier support 20*d*, the control unit 4 updates the processing state of this carrier support 20*d* to "in progress". This processing state is updated to "not in progress" when the last wafer W (recognizable by the ID) in the carrier C placed on the carrier support 20*d* has finished the treatment and deposited back in the original position in that carrier C. When start instructions are inputted through the switch units 20*c* corresponding to a plurality of carrier supports 20*d*, the processing states of all of these carrier supports 20*d* are updated to "in progress". Then, the processes shown in FIG. 6 are executed in the order in which the start instructions are inputted. When all wafers W in one carrier C have been treated, the control unit 4 updates the processing state of the carrier C (carrier support 20*d*) to "not in progress", and checks if there are other carrier supports 20*d* "in progress". If there are, the processes of FIG. 6 are continued for the wafers W in the carrier C to which the start instruction was given earliest among these other carriers C. Subsequently, the processes of FIG. 6 are continued until the processing states of all of the carrier supports 20*d* become "not in progress".

In this way, the apparatus 1 may continuously treat wafers W in one carrier C or wafers W in a plurality of carriers C. In this apparatus 1, therefore, the wafers W contained in one or more carriers C and continuously treated constitute one lot according to this invention. Where the treatment is continuously performed for wafer(s) W in one carrier C and the carrier C contains only one wafer W, this one wafer W forms one lot.

Next, the control of the treating solution supply system of this apparatus 1 will be described.

In this embodiment, the storage tank 5 of each treating solution supply mechanism 3 begins to be pressurized upon input of a start instruction.

Figure 6:
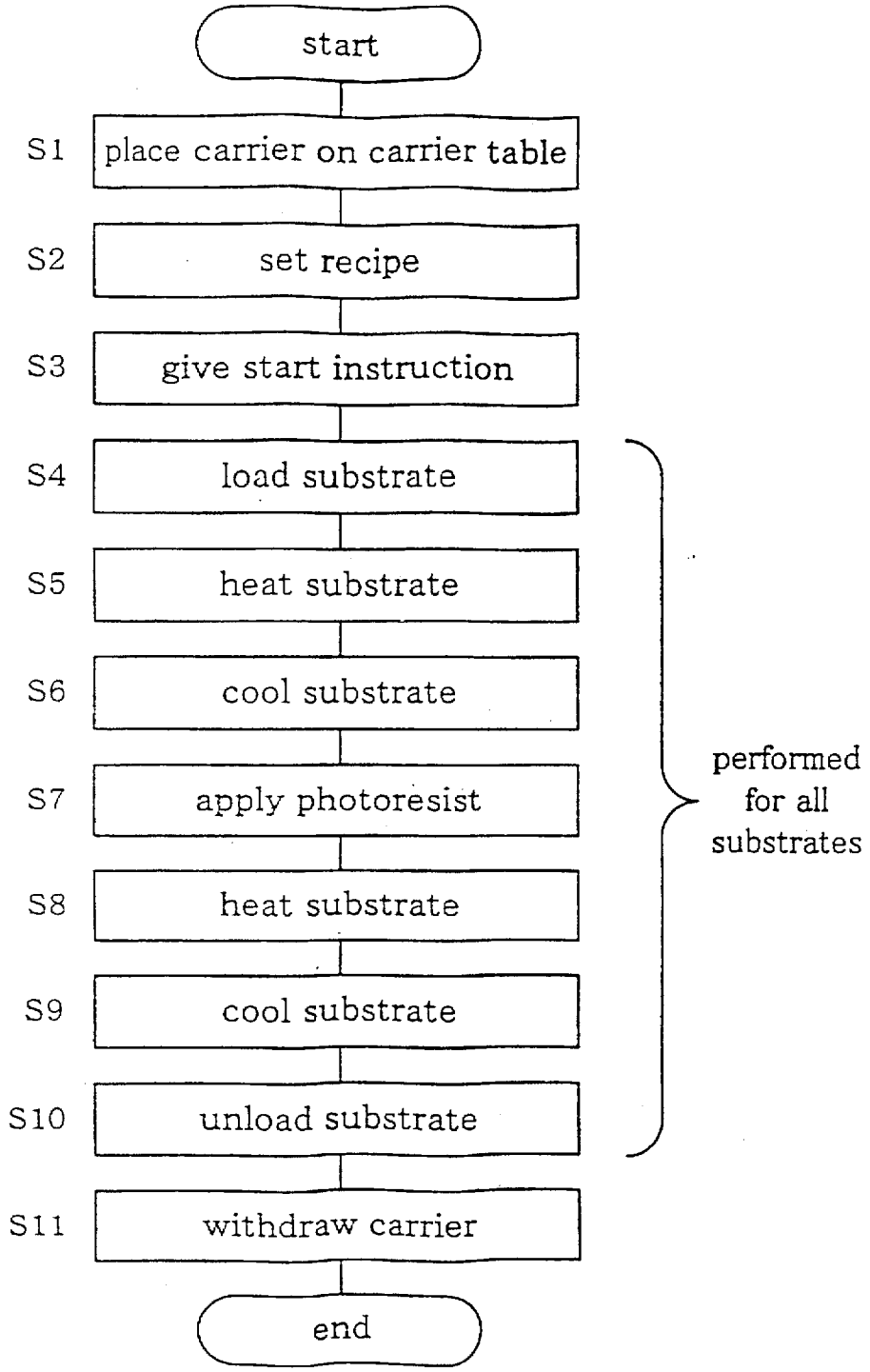
FIG. 6 is a flowchart of a processing sequence of the apparatus shown in FIG. 3.

As noted hereinbefore, a start instruction initiates execution of steps S4–S10 shown in FIG. 6 for each wafer W. Enough time passes from input of a start instruction (from start of pressurization of the storage tank 5 of each treating solution supply mechanism 3) to entry to the spin coater 2 of the first wafer W in one lot (i.e. wafer W loaded first) and start of photoresist solution supply. Thus, by the time the photoresist solution is supplied to the first wafer W, each storage tank 5 has been pressurized to a degree for supplying a solution. For supplying the photoresist solution to all wafers W including the first wafer W, the control unit 4 opens the switch valve 9 of the treating solution supply mechanism 3 used to supply the photoresist solution. The switch valve 9 is closed, when the photoresist solution has been supplied in a predetermined quantity, to stop the photoresist solution supply. The edge rinse solution and back rinse solution are supplied and stopped in the same way by operating the switch valves 9 of the respective treating solution supply mechanisms 3.

When each wafer W is subsequently transported to the spin coater 2, the photoresist solution, edge rinse solution and back rinse solution are supplied as described above.

After the last wafer W (the wafer W loaded last) is transported into the spin coater 2 and the supply of the photoresist solution to that wafer W is stopped, the pressurization of the storage tank 5 of the treating solution supply mechanism 3 supplying the photoresist solution is stopped and pressure is released therefrom. Similarly, after the supply of the edge rinse solution and back rinse solution to the last wafer W is stopped, the pressurization of the storage tanks 5 of the respective treating solution supply mechanisms 3 supplying the edge rinse solution and back rinse solution is stopped and pressure is released therefrom. The control unit 4 stores the points of time at which the respective solutions are supplied and stopped.

Thus, as described with reference to FIG. 2, each treating solution storage tank 5 is pressurized for a shorter period of time than in the conventional apparatus.

In this type of substrate treating apparatus 1, the spin coater 2 may include a plurality of resist supplying nozzles 2*b* for supplying varied types of photoresist solutions to wafers W. In this case, each nozzle 2*b* is connected to a separate treating solution supply mechanism 3. Different types of photoresist solution may be applied to different wafers W stored in carrier C.

Where, for example, a plurality of wafers W1 to Wk are stored in carrier C, photoresist solution A may be applied to wafers W1–Wi, photoresist solution B to wafers W(i+1) to Wj, and photoresist solution C to wafers W(j+1) to Wk (wherein $i<j<k$). All of the wafers W1–Wk undergo edge rinsing and back rinsing as well.

When a start instruction is given in the above instance, wafers W1–Wk are successively loaded into the apparatus 1 for treatment. The wafers W1–Wk constitute one lot for the treating solution supply mechanisms 3 supplying the edge rinse and back rinse solutions. The wafers W1–Wi constitute one lot for the treating solution supply mechanism 3 supplying photoresist solution A. The wafers W(i+1) to Wj constitute one lot for the treating solution supply mechanism 3 supplying photoresist solution B. The wafers W(j+1) to Wk constitute one lot for the treating solution supply mechanism 3 supplying photoresist solution C.

In this case, a start of pressurization and a pressure release may be effected simultaneously for all of the treating solution supply mechanisms 3, or their timing may be varied for the different lots corresponding to the respective treating solution supply mechanisms 3. For example, when a start instruction is inputted or when wafer W1 is loaded into the apparatus 1, pressurization may be started for the treating solution supply mechanisms 3 which supply the edge rinse and back rinse solutions, and for the treating solution supply mechanism 3 which supplies photoresist solution A. When photoresist solution A is stopped being supplied to wafer Wi, pressure may be released from the treating solution supply mechanism 3 supplying photoresist solution A. When wafer W(i+1) is loaded into the apparatus 1, pressurization may be started for the treating solution supply mechanism 3 which supplies photoresist solution B. When photoresist solution B is stopped being supplied to wafer Wj, pressure may be released from the treating solution supply mechanism 3 supplying photoresist solution B. When wafer W(j+1) is loaded into the apparatus 1, pressurization may be started for the treating solution supply mechanism 3 which supplies photoresist solution C. When photoresist solution C is stopped being supplied to wafer Wk, when the edge rinse solution is stopped being supplied and when the back rinse solution is stopped being supplied, pressure may be released from the treating solution supply mechanism 3 supplying photoresist solution C, and from the treating solution supply mechanisms 3 supplying the edge rinse and back rinse solutions. The gas may dissolve in a further reduced quantity in the treating solution inside the storage tank 5 of each treating solution supply mechanism 3 by assiduously controlling the start of pressurization and the pressure release for the treating solution supply mechanisms 3 as described above.

It will be appreciated from the above example that, for certain of the treating solution supply mechanisms 3, a plurality of wafers W stored in one carrier C and successively treated by the apparatus 1 may constitute a plurality of lots (the number of lots being equal to or smaller than the number of wafers W stored). Where 25 wafers W are stored in carrier C, these wafers W may be handled as 25 lots.

In above description, each treating solution storage tank 5 begins to be pressurized upon a start instruction, and the pressurization is stopped and pressure is released when the supply of each solution is stopped. However, the pressurization and pressure release may be started at other times as set out hereunder.

<Timing of Starting Pressurization>

Pressurization needs to be started preparatory to supplying of the treating solutions to the first wafer W in one lot, and at least before a period of time (ts) taken from start of the pressurization of the storage tanks 5 to the time at which their interiors become pressurized to a degree for enabling the treating solutions to be supplied to the spin coater 2. As long as these conditions are met, pressurization may be started at the following points of time (S-1) through (S-7):

(S-1) When the first wafer W is loaded into the apparatus 1 at step S4 in FIG. 6.

(S-2) When the first wafer W is transported to the heater at step S5 in FIG. 6.

(S-3) When heating of the first wafer W in the heater is completed at step S5 in FIG. 6.

(S-4) When the first wafer W is withdrawn from the heater after the heating at step S5 in FIG. 6.

(S-5) When the first wafer W is transported to the cooler at step S6 in FIG. 6.

(S-6) When cooling of the first wafer W in the cooler is completed at step S6 in FIG. 6.

(S-7) When the first wafer W is withdrawn from the cooler after the cooling at step S6 in FIG. 6.

At each of the above points of time, a timing signal is transmitted from the heat-treating unit 21 or substrate transport robot 22 to the control unit 4, or from the control unit 4 to the heat-treating unit 21 or substrate transport robot 22. Thus, the control unit 4 stores the above points of time.

To realize a reduced pressurization time for the solution storage tanks 5, pressurization should be started the period of time ts, or a slightly longer period of time (ts+α), before the treating solutions begin to be supplied to the first wafer W.

<Timing of Releasing Pressure>

To realize a reduced pressurization time for the treating solution storage tanks 5, pressure should suitably be released when stopping the treating solution supply to the last wafer W as noted hereinbefore. However, pressure may be released at the following other points of time (E-1) through (E-11):

(E-1) When the treatment in the spin coater 2 is completed for the last wafer W at step S7 in FIG. 6.

(E-2) When the last wafer W is withdrawn from the spin coater 2 after the treatment therein at step S7 in FIG. 6.

(E-3) When the last wafer W is transported to the heater at step S8 in FIG. 6.

(E-4) When heating of the last wafer W in the heater is completed at step S8 in FIG. 6.

(E-5) When the last wafer W is withdrawn from the heater after the heating at step S8 in FIG. 6.

(E-6) When the last wafer W is transported to the cooler at step S9 in FIG. 6.

(E-7) When cooling of the last wafer W in the cooler is completed at step S9 in FIG. 6.

(E-8) When the last wafer W is withdrawn from the cooler after the cooling at step S9 in FIG. 6.

(E-9) When the last wafer W is transferred from the substrate transport robot 22 to the substrate intake/output robot **20*b* at step S10 in FIG. 6**.

(E-10) When the last wafer W is deposited in the carrier C at step S10 in FIG. 6.

(E-11) When the carrier C is removed from the carrier support **20*d* at step S11 in FIG. 6**.

At each of the above points of time, a timing signal is transmitted from the indexer 20, spin coater 2, heat-treating unit 21 or substrate transport robot 22 to the control unit 4, or from the control unit 4 to the indexer 20, spin coater 2, heat-treating unit 21 or substrate transport robot 22. Thus, the control unit 4 stores the above points of time.

The foregoing embodiment has been described, exemplifying a substrate treating apparatus having a spin coater 2. This invention is equally applicable to other types of substrate treating apparatus for treating substrates with treating solutions supplied under gas pressure. Such a substrate treating apparatus may have a spin developer for development processing, or both a spin coater and a spin developer.

The present invention may be embodied in other specific forms without departing from the spirit or essential attributes thereof and, accordingly, reference should be made to the appended claims, rather than to the foregoing specification, as indicating the scope of the invention.

What is claimed is:

1. In a substrate treating apparatus having at least one substrate treating station for performing a predetermined treatment of substrates by supplying a predetermined treating solution to the substrates, and at least one treating solution supply mechanism for supplying the treating solution by a forced feed under gas pressure to the substrate treating station, said treating solution supply mechanism comprising:

a treating solution storage tank for storing a predetermined treating solution;

pressurizing means for pressurizing said treating solution storage tank by supplying a gas thereto;

pressure release means for releasing pressure from said treating solution storage tank; and solution supply/stop changeover means for selectively starting and stopping supply of the treating solution from said treating solution storage tank to said substrate treating station;

said apparatus comprising control means for causing at least one substrate treated with one type of treating solution in said substrate treating apparatus to be processed as one lot, said control means being operable to start pressurization of the treating solution storage tank at a predetermined time before the treating solution is supplied to a first substrate in said lot, and to effect a control for each lot to release pressure from said treating solution storage tank based on a time at which the supply of said treating solution is stopped to a last substrate in said lot or at a predetermined slightly later time.

2. A substrate treating apparatus as defined in claim 1, wherein said control means is operable, prior to starting the supply of the treating solution to said first substrate in said lot, to start pressurization of the treating solution storage tank, before a period of time taken from start of the pressurization of said treating solution storage tank to a time when said treating solution storage tank is pressurized to a degree enabling the treating solution to be supplied from said treating solution storage tank to said substrate treating station, or a slightly longer period of time.

3. A substrate treating apparatus as defined in claim 2, wherein said control means is operable to determine said period from the start of pressurization of said treating solution storage tank to when said treating solution storage tank is pressurized to the degree enabling the treating solution to be supplied from said treating solution storage tank to said substrate treating station, by capacity of said storage tank and gas supply per unit time to said storage tank.

4. A substrate treating apparatus as defined in claim 3, wherein said control means is operable to determine said period taken from the start of the pressurization of said treating solution storage tank to when said treating solution storage tank is pressurized to the degree for enabling the treating solution to be supplied from said treating solution storage tank to said substrate treating station, also by a residual quantity of the treating solution in said storage tank.

5. A substrate treating apparatus as defined in claim 1, further comprising a plurality of treating solution supply mechanisms for individually supplying different treating solutions said control means being operable to control start of the pressurization and pressure release for said treating solution supply mechanisms based on respective lots to which said treating solution supply mechanisms are directed.

6. A substrate treating apparatus as defined in claim 1, further comprising a plurality of treating solution supply mechanisms for individually supplying the same treating solution to the same substrate treating station, said control means being operable to switch operation between said plurality of treating solution supply mechanisms, and to control start of the pressurization and pressure release for one of said treating solution supply mechanisms currently used, based on respective lots to which said one treating solution supply mechanisms is directed.

7. A substrate treating apparatus as defined in claim 6, further comprising solution replenish means for replenishing said treating solution supply mechanisms with the treating solution;

wherein said control means is operable, when the treating solution remaining in the treating solution storage tank of said one treating solution supply mechanisms currently used falls below a predetermined level, to switch from said one treating solution supply mechanisms currently used to a different treating solution supply mechanism for supplying the same treating solution to the substrate treating station as said one treating solution supply mechanisms, and to cause said solution replenish means to replenish the treating solution storage tank one of said treating solution supply mechanisms with the treating solution.

8. A substrate treating apparatus as defined in claim 1, further comprising:

at least one carrier support for supporting a carrier having a capacity for storing a plurality of substrates;

at least one switch unit associated with said carrier support for inputting treating conditions and a treatment start instruction with respect to at least one substrate stored in said carrier placed on said carrier support; and transport means for fetching said substrate(s) successively, transporting said substrate(s) successively according to a predetermined treating sequence, and depositing said substrate(s) successively in said carrier after a predetermined treatment;

wherein said control means is operable, in response to the treatment start instruction inputted through said switch unit, to control said transport means and said substrate treating station to successively treat the substrate(s) taken out of the carrier placed on the carrier support associated with the switch unit through which said treatment start instruction is inputted, according to the treating conditions designated, and to control start of the pressurization and release of the pressure for at least one treating solution supply mechanism used in continuous treatment of the substrate(s), based on respective lots to which said at least one treating solution supply mechanism is directed.

9. A substrate treating apparatus as defined in claim 8, wherein said apparatus comprises a plurality of carrier supports, and switch units associated with said carrier supports, respectively, said control means being operable, in response to treatment start instructions inputted through said switch units, to cause all substrates stored in a plurality of carriers to be treated successively in an order in which said treatment start instructions are inputted.

10. A substrate treating apparatus as defined in claim 8, wherein the apparatus has a plurality of treating solution supply mechanisms, and said control means is operable to start pressurization for all of said treating solution supply mechanisms to be used in the successive treatment of the substrates carried out upon said treatment start instructions, at points of time said treatment start instructions are inputted.

11. A substrate treating apparatus as defined in claim 8, wherein the apparatus has a plurality of treating solution supplying mechanisms, and said control means is operable to start pressurization for said treating solution supply mechanisms, respectively, to be used in the successive treatment of the substrates carried out upon said treatment start instructions, at points of time said treatment start instructions are inputted, or at points of time first substrates in said respective lots to which said treating solution supply mechanisms are directed are transported from said carrier into said transport treating apparatus.

12. In a substrate treating apparatus having at least one substrate treating station for performing a predetermined treatment of substrates by supplying a predetermined treating solution to the substrates, and at least one treating solution supply mechanism for supplying the treating solution in a forced feed under gas pressure to the substrate treating station, said treating solution supply mechanism comprising:

a treating solution storage tank for storing a predetermined treating solution;

a pressurizing device pressurizing said treating solution storage tank by supplying a gas thereto;

a pressure release device releasing pressure from said treating solution storage tank; and a solution supply/stop changeover device selectively allowing and stopping supply of the treating solution from said treating solution storage tank to said substrate treating station;

said apparatus comprising a control device causing at least one substrate treated with one type of treating solution in said substrate treating apparatus to be processed as one lot, said control device being operable to start pressurization of the treating solution storage tank at a predetermined time before the treating solution is supplied to a first substrate in said lot, and to effect a control for each lot to release pressure from said treating solution storage tank based on a time at which the supply of said treating solution is stopped to a last substrate in said lot or at a predetermined slightly later time.

13. A substrate treating apparatus as defined in claim 12, wherein said control device is operable, prior to starting the supply of the treating solution to said first substrate in said lot, to start pressurization of the treating solution storage tank before a period of time taken from start of the pressurization of said treating solution storage tank to a time when said treating solution storage tank is pressurized to a degree enabling the treating solution to be supplied from said treating solution storage tank to said substrate treating station, or a slightly longer period of time.

14. A substrate treating apparatus as defined in claim 13, wherein said control device is operable to determine said period from the start of pressurization of said treating solution storage tank to when said treating solution storage tank is pressurized to the degree enabling the treating solution to be supplied from said treating solution storage tank to said substrate treating station, by capacity of said storage tank and gas supply per unit time to said storage tank.

15. A substrate treating apparatus as defined in claim 14, wherein said control device is operable to determine said period taken from the start of the pressurization of said treating solution storage tank to when said treating solution storage tank is pressurized to the degree for enabling the treating solution to be supplied from said treating solution storage tank to said substrate treating station, also by a residual quantity of the treating solution in said storage tank.

16. A substrate treating apparatus as defined in claim 12, further comprising a plurality of treating solution supply mechanisms for individually supplying different treating solutions, said control device being operable to control start of the pressurization and pressure release for said treating solution supply mechanisms based on respective lots to which said treating solution supply mechanisms are directed.

17. A substrate treating apparatus as defined in claim 12, further comprising a plurality of treating solution supply mechanisms for individually supplying the same treating solution to the same substrate treating station, said control device being operable to switch operation between said plurality of treating solution supply mechanisms, and to control start of the pressurization and pressure release for one of said treating solution supply mechanisms currently used, based on respective lots to which said one treating solution supply mechanisms is directed.

18. A substrate treating apparatus as defined in claim 17, further comprising a solution replenish device for replenishing said treating solution supply mechanisms with the treating solution;

wherein said control device is operable, when the treating solution remaining in the treating solution storage tank of said one treating solution supply mechanisms currently used falls below a predetermined level, to switch from said one treating solution supply mechanisms currently used to a different treating solution supply mechanism for supplying the same treating solution to the substrate treating station as said one treating solution supply mechanisms, and to cause said solution replenish means to replenish the treating solution storage tank of said one treating solution supply mechanisms with the treating solution.

19. A substrate treating apparatus as defined in claim 12, further comprising:

at least one carrier support for supporting a carrier having a capacity for storing a plurality of substrates;

at least one switch unit associated with said carrier support for inputting treating conditions and a treatment start instruction with respect to at least one substrate stored in said carrier placed on said carrier support; and a transport device for fetching said substrate(s) successively, transporting said substrate(s) successively according to predetermined treating sequence, and depositing said substrate(s) successively in said carrier after a predetermined treatment;

wherein said control device is operable, in response to the treatment start instruction inputted through said switch unit, to control said transport device and said substrate treating station to successively treat the substrate(s) taken out of the carrier placed on the carrier support associated with the switch unit through which said treatment start instruction is inputted, according to the treating conditions designated, and to control start of the pressurization and release of the pressure for at least one treating solution supply mechanism used in continuous treatment of the substrate(s), based on respective lots to which said at least one treating solution supply mechanism is directed.

20. A substrate treating apparatus as defined in claim 19, wherein said apparatus comprises a plurality of carrier supports, and switch units associated with said carrier supports, respectively, said control device being operable, in response to treatment start instructions inputted through said switch units, to cause all substrates stored in a plurality of carriers to be treated successively in an order in which said treatment start instructions are inputted.

21. A substrate treating apparatus as defined in claim 19, wherein said control device is operable to start pressurization for all of said treating solution supply mechanisms to be used in the successive treatment of the substrates carried out upon said treatment start instructions, at points of time said treatment start instructions are inputted.

22. A substrate treating apparatus as defined in claim 19, wherein said control device is operable to start pressurization for all of said treating solution supply mechanisms to be used in the successive treatment of the substrates carried out upon said treatment start instructions, at points of time said treatment start instructions are inputted, or at points of time first substrates in said respective lots to which said treating solution supply mechanisms are directed are transported from said carrier into said transport treating apparatus.

* * * * *